United States Patent [19]

Gacek

[11] Patent Number: 4,513,502

[45] Date of Patent: Apr. 30, 1985

[54] BEVERAGE LID CUTTER

[76] Inventor: John J. Gacek, 292 Hendrick Ave., Albany, N.Y. 12204

[21] Appl. No.: 470,775

[22] Filed: Feb. 28, 1983

[51] Int. Cl.[3] ..... B26D 7/01; B26F 1/12

[52] U.S. Cl. ..... 30/229; 30/233; 30/241; 83/693

[58] Field of Search ..... 30/443, 446, 447, 358, 30/366, 224, 229, 233, 241; 83/693, 671

[56] References Cited

U.S. PATENT DOCUMENTS

| | | | |
|---|---|---|---|
| 669,231 | 3/1901 | Carmody | 30/229 |
| 1,531,287 | 3/1925 | Jensen | 83/693 X |
| 1,702,728 | 2/1929 | Erickson | 30/229 |
| 2,473,604 | 6/1949 | Muth | 30/229 |
| 2,608,758 | 9/1952 | Weksel | 30/229 X |
| 2,650,663 | 9/1953 | Wales | 30/241 |
| 3,065,657 | 11/1962 | Thompson | 83/451 |
| 3,180,196 | 4/1965 | Coulon | 83/693 |
| 3,203,289 | 8/1965 | Beekley | 83/693 X |
| 3,368,441 | 12/1968 | Piazze | 83/588 |
| 3,509,625 | 5/1970 | Bajulaz | 30/233 X |
| 3,728,926 | 4/1973 | Clayton | 83/467 |

*Primary Examiner*—Jimmy C. Peters

*Attorney, Agent, or Firm*—Heslin, Watts & Rothenberg

[57] ABSTRACT

A cutting apparatus is described for cutting an opening in beverage cup lids. This is accomplished by providing a housing, with a slot for orienting and maintaining the lid in a proper cutting position. While the lid is properly held, a cutting assembly mounted inside the housing and containing a cutting blade is slid past the slot, excising that portion of the lid exposed therein. When the cut lid is placed on a beverage containing cup, the contents can be consumed directly through the opening produced by this invention.

13 Claims, 7 Drawing Figures

BEVERAGE LID CUTTER

BACKGROUND AND SUMMARY OF THE INVENTION

The present invention is a device relating to the cutting of an opening in a disposable beverage cup lid so that when the cut lid is placed on a beverage containing cup, one can drink the beverage therethrough without any splashing or spilling of the liquid contents.

The pace of today's society is producing an ever increasing demand for fast food and drink establishments. A frequently occurring problem is how to drink a recently purchased hot cup of coffee while commuting to or from work. Currently available lids for beverage cups either have no openings or have a perforated circular type opening for inserting a straw. A major objective of this invention is to provide a means for producing an opening at the periphery of a beverage cup lid that enables one to drink directly from a covered cup. A second major objective of this invention is to provide a lid cutter that is simple enough in design and easy enough to operate so that lids can be cut within seconds by relatively untrained personnel while the customer waits.

Numerous punch type cutters have been devised but none are available that are simple enough in design and capable of properly orienting a beverage cup lid for the cutting of an opening at the lid periphery, enabling one to drink beverages directly therethrough.

This invention is a novel device for cutting an opening in a beverage cup lid. The device comprises a housing that defines a plunger channel containing a slot transverse to the channel. The slot is configured so as to permit the insertion of a lid to a predetermined depth thereby exposing a portion of the lid within the channel. The slot is also configured so as to maintain the plane of the lid in a transverse orientation with respect to the channel. The device further comprises a cutting assembly having a handle, plunger and a cutting edge. The plunger is slideably mounted within the channel and the cutting edge has a configuration similar to that of at least one cutting wall of the channel. The plunger is capable of reciprocal movement within the channel between retracted and advanced positions. When the lid is placed in the slot, that portion of the lid exposed within the channel will be removed as the cutting edge moves past the slot. The cutting assembly is biased to its original retracted position by a helical spring and guidebar located within the plunger channel.

Other objects and advantages will become apparent from the following detailed descriptions made with reference to the accompanying drawings.

DETAILED DESCRIPTION OF THE INVENTION

In reference to the drawings, it will become evident that the present invention accomplishes the aforementioned objectives.

Figure 1:
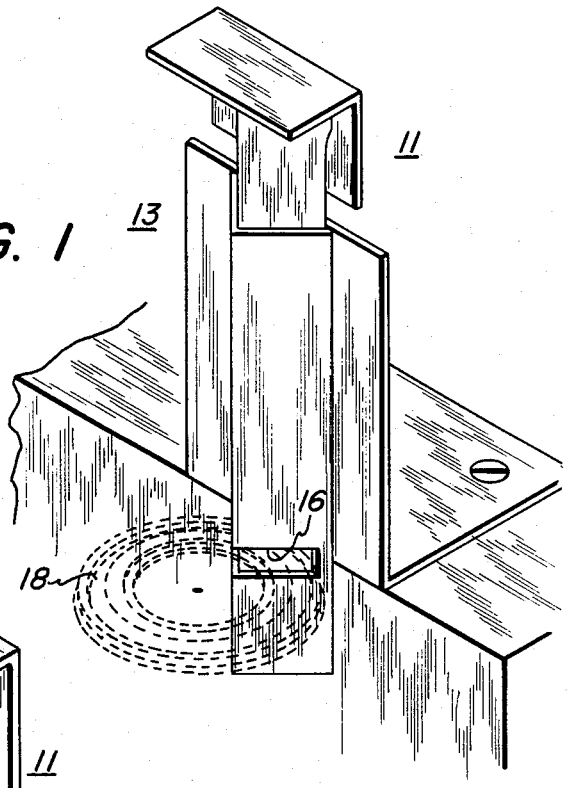
FIG. 1 is a perspective view of the lid cutter showing a lid in phantom ready to be cut.

The perspective view of FIG. 1 shows lid cutter 13 with lid 18 inserted in slot 16 in a position ready for cutting. Cutting assembly 11 is shown located in its retracted position.

Figure 2:
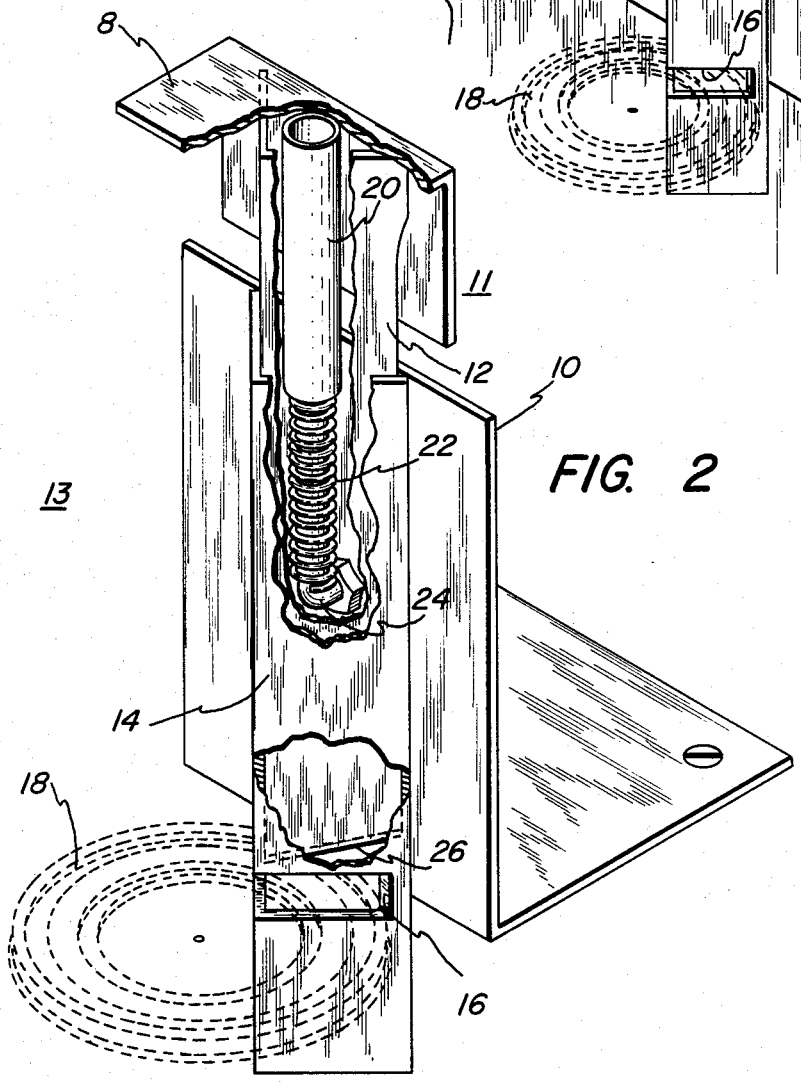
FIG. 2 is an enlarged cutaway view of FIG. 1.
Figure 3:
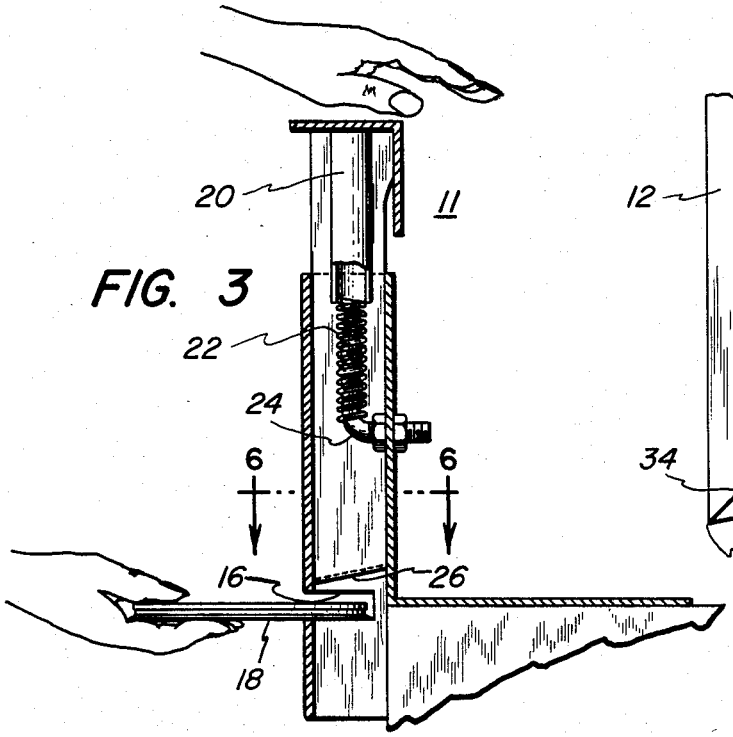
FIG. 3 is a side cross sectional elevation of the lid cutter in an operating position with the cutting assembly in a retracted position.
Figure 4:
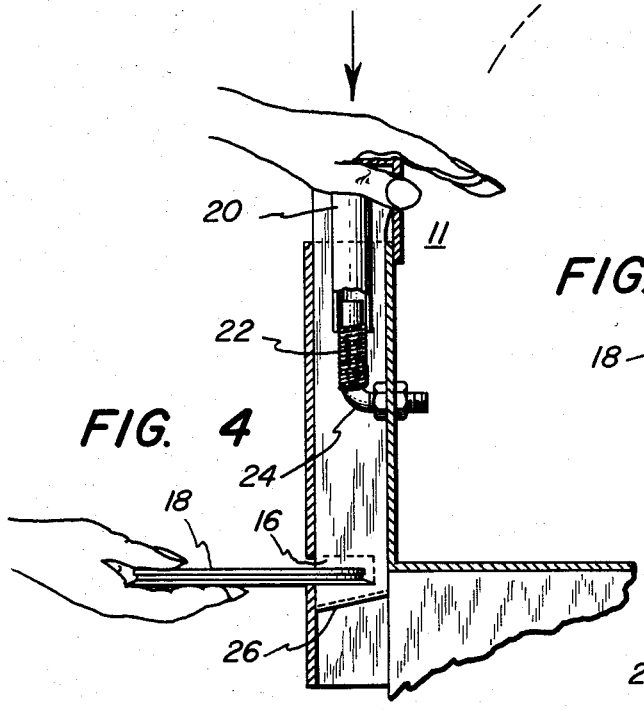
FIG. 4 is a side cross sectional elevation of the lid cutter in an operating position with the cutting assembly in an advanced position.
Figure 7:
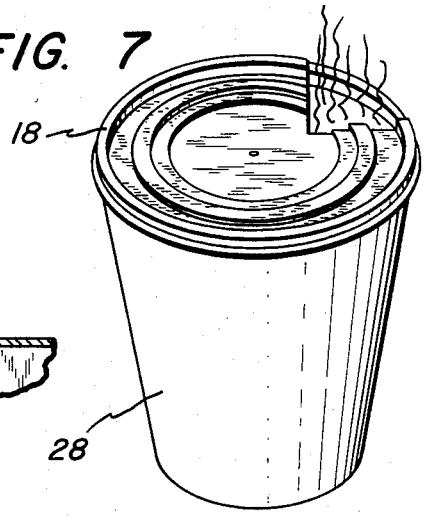
FIG. 7 is a perspective view of the cut lid in a functional mode.

The enlarged cutaway view of FIG. 2 better demonstrates the important features of lid cutter 13. Cutting assembly 11 consists essentially of three main elements: handle 8; plunger 12; and cutting edge 26. Housing 14 defines a channel whereby plunger 12 is slideably mounted therein. Housing 14 may be constructed as a separate element mounted to support 10 as shown in the drawings or housing 14 and support 10 may be constructed as one integral piece. The configuration of plunger 12 corresponds to that of housing 14, both are shown as V-shaped in the drawings. Handle 8 is mounted atop plunger 12 in order to provide a comfortable means for manually sliding plunger 12 within the channel. This mode of action is graphically illustrated in FIG. 3 and FIG. 4 showing cutting assembly 11 as it moves from its retracted position (FIG. 3) to its advanced position (FIG. 4).

The preferred means by which cutting assembly 11 is biased in its retracted position is shown in FIG. 2. Guidebar 24 is mounted axially within the channel and extends in parallel relationship with said channel. Sleeve 20 is attached to the bottom surface of handle 8 and connects with helical spring 22. The inside diameter of helical spring 22 is large enough to permit it to be slideably mounted on guidebar 24. Helical spring 22 must have sufficient length in order to maintain cutting edge 26 above slot 16 while cutting assembly 11 is in its retracted position and then to permit cutting edge 26 to move downward until it completely passes slot 16, ultimately stopping in an advanced position whereby the desired portion of lid 18 has been removed. Downward pressure as applied to handle 8 produces a concomitant compression of helical spring 22 permitting the reciprocal movement of plunger 12, with respect to guidebar 24, between its retracted and advanced position. When the downward pressure is released from handle 8, cutting assembly 11 returns to its original retracted position.

Figure 5:
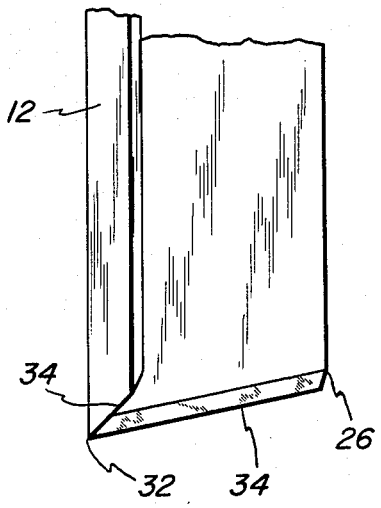
FIG. 5 is an enlarged detailed view of the cutting edge.

Cutting edge 26 is better demonstrated in the enlarged detail view of FIG. 5. Cutting edge 26, as shown, is contiguous with plunger 12. In order to produce a satisfactory cut for the removal of a portion of lid 18, it is desirable to terminate cutting edge 26 in a point 32. Then by providing cutting edge 26 with two angularly divergent blades 34, it is possible to pierce lid 18 with point 32, followed by a slicing action produced by blades 34, whereby an opening in the shape of a sector is removed from lid 18. It is also desirable to have blades 34 intersect lid 18 at its periphery in order to completely remove a sector of lid 18. Note that removal of a portion of lid 18 in the shape of a sector is only the preferred embodiment. Possible alternative embodiments could include, for example, a cutting edge in the shape of an arc that would produce an elliptical shaped opening or a straight cutting edge that would make an opening having the configuration of a segment. It should be understood that the scope of this invention is not intended to be limited by the geometric shape of the opening produced in the lid.

Figure 6:
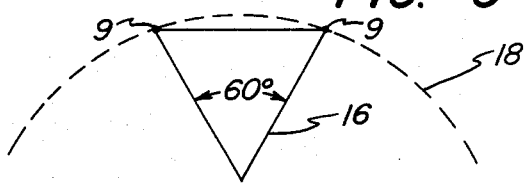
FIG. 6 is a sectional schematic view as seen from line 6—6 of FIG. 3.

The use of slot 16 for maintaining lid 18 in a proper cutting orientation is central to this invention. Slot 16 located in housing 14 must be configured so as to permit the insertion of lid 18 to a predetermined depth. The preferred dimensions of slot 16 were determined by first establishing how large the opening in lid 18 should be in order to facilitate the drinking of a beverage therethrough without weakening the support of the remaining lid. It was experimentally determined that when housing 14 is V-shaped, the width of slot 16 as measured along line 9—9 in FIG. 6 should be approximately 1½ inches. When angularly divergent blades 34 are set apart by an angle of about 60° and lid 18 is inserted to a depth of about 1¼ inches, the exposed sector of lid 18 within the channel is of proper cutting size. The height of slot 16 should be just greater than the thickness of lid 18 in order to allow for easy insertion, while also being able to maintain the plane of lid 18 in a transverse orientation with respect to the channel, while cutting is in progress. As shown in the drawings, the preferred orientation of slot 16 to the plane of lid 18 is perpendicular; however, it is conceivable that other orientation may be utilized.

A support means 10 has been provided for maintaining lid cutter 13 in an upright and secure position. Support means 10 has been adapted to situate lid cutter 13 on a flat counter-type surface.

It will be understood that various changes and modifications may be made in the above described apparatus without departing from the spirit thereof, particularly as defined in the following claims.

That which is claimed is:

1. A beverage lid cutter comprising:

a housing defining a plunger channel having at least one cutting wall and containing a slot transverse to the channel, said slot being configured so as to permit the insertion of a lid to a predetermined depth, thereby exposing a portion of the lid within the channel, and said slot also being configured so as to maintain the plane of the lid in a transverse orientation with respect to the channel;

a cutting assembly including a plunger slidably mounted within the channel, said plunger having a cutting edge with a configuration similar to that of the at least one cutting wall and being in slideable contact therewith, and said plunger being reciprocally operable within the channel between a retracted position and an advanced position such that the cutting edge passes the slot as the plunger moves from its retracted position to its advanced position, whereby the exposed portion of the lid inserted in the slot while the plunger is retracted will be removed as the plunger is moved to its advanced position, wherein the cutting assembly is mounted within the channel by means of a guidebar mounted axially within the channel; and a sleeve rigidly connected to the cutting assembly, said sleeve being adapted to permit cooperative reciprocal movement of the plunger with respect to the guidebar.

2. The invention of claim 1 in further combination with a support means for maintaining the lid cutter in a secure cutting position.

3. The invention of claim 1 wherein said plunger includes a handle mounted in such a manner as to permit manual movement of said plunger from its retracted position to its advanced position.

4. The invention of claim 2 wherein the guidebar is mounted to the support means in a fixed position.

5. The invention of claim 4 in further combination with means for biasing the plunger to its retracted position.

6. The invention of claim 1 wherein said cutting edge terminates in a point.

7. The invention of claim 6 wherein said cutting edge contains two angularly divergent blades of equal size radiating from said point.

8. The invention of claim 7 wherein said angularly divergent blades intersect said lid at its periphery.

9. The invention of claim 1 including a means whereby the cutting edge will stop at a predetermined advanced position.

10. The invention of claim 2 wherein the support means includes means for mounting on a flat surface.

11. A beverage lid cutter comprising:

an L-shaped support member, one leg of which is adapted for attachment to a flat surface;

a housing attached to the other leg of the support member, said housing defining a plunger channel having at least one cutting wall and containing a slot transverse to the channel, said slot being configured so as to permit the insertion of a lid to a predetermined depth, thereby exposing a portion of the lid within the channel, and said slot also being configured so as to maintain the plane of the lid in a transverse orientation with respect to the channel;

an L-shaped guide bar rigidly attached by one of its legs to said other leg of the support member so that the other leg of the bar lies in a plane parallel to that of the other support member leg and also lies within the plunger channel;

a cutting assembly including a plunger slideably mounted within the channel, said plunger having a cutting edge with a configuration similar to that of the at lease one cutting wall and being in slideable contact therewith;

a sleeve rigidly connected to the cutting assembly for movement therewith, said sleeve being slideably mounted over said other leg of the guide bar so as to permit a reciprocating movement with respect thereto;

a spring slideably mounted on the said other leg of the guide bar between its one leg and said sleeve so as to bias said sleeve away from the one leg of the guide bar.

12. The invention of claim 11 wherein the housing and the cutting assembly are both V-shaped, the legs of each subtending an angle of substantially 60°.

13. The invention of claim 12 wherein the cutting edge of the plunger is provided with a leading point for piercing lids to be cut and said cutting edge is further comprised of two angularly divergent blades radiating from said point.

* * * * *